US005267448A

United States Patent [19]

Van Den Heuvel

[11] Patent Number: 5,267,448

[45] Date of Patent: Dec. 7, 1993

[54] BULK BEVERAGE COOLING AND SERVING DEVICE

[76] Inventor: Ronald W. Van Den Heuvel, Rte. 2, Box 60, Cadott, Wis. 54727

[21] Appl. No.: 897,910

[22] Filed: Jun. 12, 1992

[51] Int. Cl.[5] ..... F25D 17/02

[52] U.S. Cl. ..... 62/64; 62/239; 62/376; 62/435

[58] Field of Search ..... 62/64, 373, 376, 431, 62/433, 435, 237, 239

[56] References Cited

U.S. PATENT DOCUMENTS

| | | | |
|---|---|---|---|
| Re. 15,683 | 9/1923 | Peterson | 62/62 |
| 634,070 | 10/1899 | Smith | 62/460 |
| 1,782,840 | 11/1930 | Cann | 62/373 |
| 2,080,885 | 5/1937 | Cocks | 62/433 X |
| 2,104,684 | 1/1938 | Wilson, Jr. | 62/79 |
| 2,183,090 | 12/1939 | Boone | 62/142 |
| 2,226,271 | 12/1940 | Vose | 62/373 X |
| 2,355,793 | 8/1944 | Fyock | 62/435 X |
| 2,418,300 | 4/1947 | Hagstrom | 62/376 |
| 2,512,066 | 6/1950 | Linfor | 62/4 |
| 2,546,417 | 3/1951 | Anglin | 62/435 X |
| 2,620,636 | 12/1952 | Stanton | 62/237 X |
| 2,734,349 | 2/1956 | Repking et al. | 62/83 |
| 3,368,361 | 2/1968 | Rietdijk | 62/45 |
| 4,454,723 | 6/1984 | Weasel, Jr. | 62/64 |
| 4,565,073 | 1/1986 | Lavender | 62/373 |

*Primary Examiner*—William E. Tapolcai
*Attorney, Agent, or Firm*—M. Paul Hendrickson

[57] ABSTRACT

A mechanical cooling device equipped with a bulk serving tank, a large capacity cooling compressor, a plurality of removable beverage retaining compartments sized so as to retain beverage cans in a rowed relationship, and a serving tank filled with a liquid coolant may be effectively utilized to rapidly cool and serve large quantities of beverages to large crowds such as often arise at festive events. The cooling device may be equipped with mobile means to permit its transport from site to site, levelers for leveling the device at the site and locking means for securing the beverages against theft. A circulatory system prevents localized freezing by uniformly circulating the coolant throughout the tank.

18 Claims, 4 Drawing Sheets

BULK BEVERAGE COOLING AND SERVING DEVICE

FIELD OF THE INVENTION

The present invention pertains to a cooling device for effectively serving large beverage quantities and its use, and more particularly to a bulk beverage cooler for dispensing large volumes of contained beverages to crowds such as at celebrations and festive occasions.

BACKGROUND OF THE INVENTION

Numerous communities and other organizations annually sponsor celebrations, fairs, festive occasions or similar events. These events often draw very huge crowds who often consume vast amounts of beverages or refreshments and especially when these events are held during the hot summer months. The beverage revenues often constitute a major income source for the sponsoring organization.

Conventional beverage or refreshment dispensers usually fail to afford sufficient cooling capacity or accessibility to dispense the abnormally high demand for beverages or refreshments at such crowded events. Consequently, the manner in which such beverages or refreshments have been heretofore served at such crowded celebrations remains substantially the same as it existed for the past hundred years or more. The most common practice for dispensing such beverages and refreshments involves icing and serving containerized or capped beverages or refreshments (e.g. such as bottled or canned beverages often referenced herein as capped beverages) directly from a large uninsulated holding tank or receptacle such as a large animal watering tank.

Several hours of pre-cooling and numerous cooling tanks are normally required to provide adequate cooling capacity for the cooled beverages or refreshments. Large amounts of ice cakes are consumed each day in order to appropriately cool the beverage and refreshments. Although several decades ago ice cakes were readily available at a relatively low cost, the costs and amounts of ice consumed at current events constitutes a major expense. Several thousands of dollars can easily be spent within a few days to ice beverages at a major celebration.

The dispensing of beverages or refreshments from large cooling tanks presents a number of other problems and disadvantages. It is typically necessary to dilute the ice with water so as to enable the server to readily locate the appropriate beverage or refreshment brand within the serving tank. As the ice melts, the water level tends to rise and more ice is periodically needed to maintain a proper cooling temperature. The excess water must be periodically drained or siphoned from the serving tanks. Meanwhile the servers will typically reach into the cold water with their hands and/or arms to retrieve the capped beverages from the tank. This creates a relatively unhealthy environment to the server as well as for the consuming public since the patrons normally drink the beverage or refreshment directly from the uncapped container.

Typically a number of different refreshment or beverage brands are also dispensed from a single cooling tank. This leads to inefficiencies not only in locating the appropriate beverage brand within the tank but also creates problems in maintaining a proper inventory control of the various cooled beverage brands. Consequently, difficulties in maintaining a proper amount of cooled beverages of each brand arises and shortages frequently occur during the event. Consumption and beverage serving often occurs upon bare or unimproved grounds in a tented or sometimes unsheltered environment. From time to time excess water must be drained or siphoned from the serving tanks as the ice melts and fresh ice is added to replenish the depleted ice stock. Normal water removal practices often simply entail opening a drain plug so as to allow the excess water to run onto the bare ground. Environmental and sanitation problems can arise from such practices.

More often than not, these events and celebrations are conducted in an unsecured or unprotected surrounding. The cooling tanks generally require attendance and monitoring several hours before serving and a constant attention throughout the entire event (often several days) so as to maintain proper icing and security to the beverages. During the nighttime hours crews to guard against theft and drain excess water from the tanks and to restock ice to the tanks are typically required.

The U.S. Patents do not appear to recognize the inadequacies of current practices. There accordingly exists within the U.S. patent literature a failure to recognize a long felt need or even more remote the physical embodiments whereby such a long felt need may be fulfilled. Several U.S. Patents cover various patented aspects of milk coolers for cooling ten-gallon milk cans at the farm. Illustrative of such patented milk coolers are U.S. Pat. No. 2,104,684 to Wilson, Jr. which discloses a three compartment milk cooler wherein the inner compartment serves to cool ten-gallon milk cans immersed in water while the outer compartments serve as an ice reservoir for cooling the inner compartment. In U.S. Pat. No. 1,782,840 to Cann, there is disclosed a milk cooler for mechanically cooling ten-gallon milk cans immersed in water within the tank by means of mechanical refrigerant coils positioned about the cooling tank wall. A mechanical milk cooler of the ten-gallon can cooling type equipped with an ice bank control system is disclosed in U.S. Pat. No. 2,512,066 to Linfor.

In Reissue Pat. No. 15,683 to Peterson there is disclosed a rack for quick freezing unpackaged meat articles by immersing racked meats into a freezing refrigerant. Similarly, a freezing frame for holding and freezing blood plasma contained in flexible bags is disclosed in U.S. Pat. No. 4,565,073 to Lavender. U.S. Pat. No. 3,368,361 to Rietdijk discloses a device for maintaining articles at a low temperature (e.g. liquid helium coolant) within housing have receptacles therein spaced at different levels. U.S. Pat. No. 4,734,344 by Repking et al discloses a refrigerated container suitable for shipping perishable articles such as flowers in which a compartmentalized insert loaded with ice is inserted into the container to keep the perishables cool. A milk crate for holding ice around milk bottles is disclosed in U.S. Pat. No. 2,183,090 to Boone. U.S. Pat. No. 634,070 to Smith discloses a milk rack for carrying milk bottles which includes an ice cage for ice. A semi-trailer equipped with sprinkler heads to chill fresh produce with cold water and liquid nitrogen feed into the water so as to cool the water spray and to also purge the trailer of oxygen is disclosed in U.S. Pat. No. 4,454,723 to Weasel, Jr.

The aforementioned patents are reflective of the failure of the art to direct its attention to those problems associated with serving containerized beverages to large crowds of people. Throughout the last century or so, the devices and the methodology for serving large crowds has remained substantially unchanged.

SUMMARY OF THE INVENTION

The present invention provides a mechanical cooling device which alleviates the inadequacies of the prior devices and practices, and that may be effectively utilized to serve large quantities of capped beverages to large crowds. The cooling device comprises an insulated serving tank equipped with a cooling compressor of a sufficient capacity to rapidly cool a multitude of cases of beverage containers within a cooling chamber of the serving tank. The cooling chamber is fitted with a plurality of retaining baskets of a size and configuration so as to retain bottled or canned beverages in a systematic arrangement. The baskets serve as a means for segregating and separately retaining the respective beverages brands (amongst several beverage brands) in an orderly fashion so as to afford an orderly means for selectively dispensing the contained beverages from the cooling tank by brand type and state of coldness. The contained beverages may be conveniently positioned within the baskets so that the server need only grasp the contained beverages from the appropriate basket without thrusting his or her appendages into cold water as is currently the case under conventional practices. The cooling device may be easily restocked simply by removing or restocking the depleted baskets with a fresh capped beverage supply. The baskets may be prearranged within the cooler in such a manner so that the colder supply baskets may be advanced or readily identified while allowing the more freshly stocked baskets to undergo additional cooling before serving.

The invention affords a substantial cost reduction for dispensing cooled beverages at crowded events. The need to transport ice from distant locations and constant monitoring to add fresh ice and drain excess water from the serving tank is avoided by this invention. The serving tanks are automatically regulated to maintain a proper cooling temperature and therefore eliminate the need to constantly monitor the ice supply. The cooling tanks may be equipped with covers and means for securing the covers (e.g. padlocks) and therefore alleviating the need for nighttime crews to monitor ice supply and guard against theft. The cooling device of this invention also allows for a much faster cooling rate of capped beverages than heretofore possible under conventional practices.

The cooling device may be conveniently fitted with means for transporting the cooling device to different sites such as a tongued hitch for hitching the cooling device onto a towing vehicle and wheels for transporting the device.

DETAILED DESCRIPTION OF THE INVENTION

Figure 1:
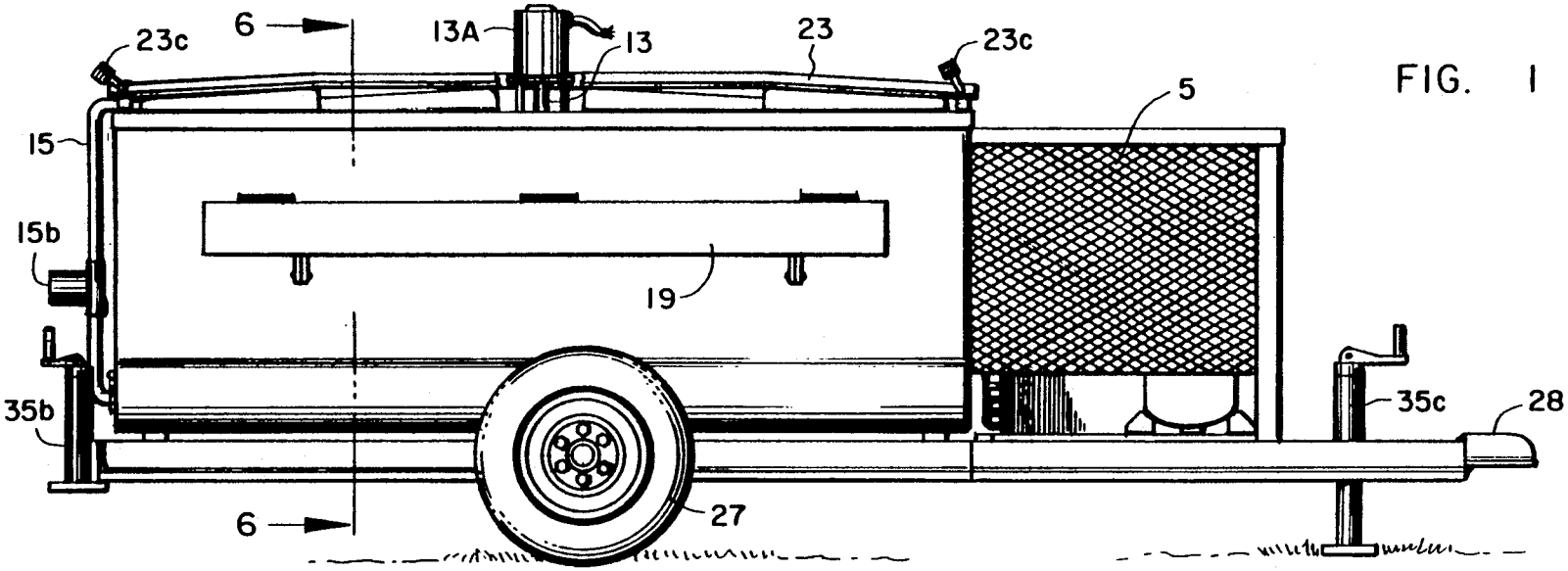
FIG. 1 depicts an external side view of the cooling device of this invention.

The cooling device of this invention and its effective use in serving large crowds of people may be better understood by referring to the accompanying FIGS. 1-8.

According to the present invention there is provided a cooling device (generally designated as 1) of a sufficient cooling capacity to effectively cool large quantities of capped beverages B (within a few hours of cooling time), said device 1 comprising an insulated bulk cooling tank (generally referred to as 3) having a capacity to hold a number of beverage cases of bottled or canned beverages B, means for cooling (generally prefixed by 5) the contained beverages within said bulk tank 3, a plurality of beverage retaining baskets (generally referenced as 7) of a size and configuration so as to retain the contained beverages B in an orderly and systematic arrangement within said baskets 7 within said holding tank 3.

Pursuant to the present invention, the cooling device 1 of this invention can effectively cool sufficient quantities of bottled or canned beverages B (often referenced herein as capped beverages) systematically arranged by beverage type within the cooling tank so as to render it particularly useful in servicing large crowds with beverages such as at fairs, festive occasions, community sponsored events and the like. In dairying, bulk milk tanks are used to rapidly cool fresh milk to a refrigeration temperature. Typically fresh milk is piped directly from a milking parlor in a large cooling tank equipped with a high capacity cooling unit which cools the liquid milk to a refrigerated temperature. Such bulk milk tanks may range in size from a few hundred gallons (about a 200 hundred gallon holding tank) to a several thousand gallons bulk tank having a holding capacity such as about 5,000 gallons or more. These bulk milk tanks when modified in accordance with the present invention provide the insulated bulk tank 3 and a particularly satisfactory means for cooling the beverages.

The cooling means 5 will generally amount to a cooling unit rated at least at 1000 B.T.U. for each 100 gallons of bulk tank volume and advantageously at least 2000 B.T.U. for each 100 gallon holding capacity of bulk tank 3. In practicing the present invention, bulk milk tanks 3 equipped with a cooling unit rated at about 4000 B.T.U. to about 12,000 B.T.U. (i.e. 1 H.P.) for each 100 gallon tank capacity are preferably used as the means 5 to cool the coolant 5A and beverages B.

The cooling unit capacity and number of cooling devices needed for any particular occasion will depend largely upon the number of people being served at the event. Small and fewer cooling units may generally be used to serve smaller crowds. Bulk tanks of a capacity ranging from about 200 to about 1500 gallon capacity are generally easier to serve to large crowds than coolers of a smaller or larger size. Cooling device 1 of about 300 to about 1200 gallon and preferably of about 500 gallon to about 1000 gallon capacity and cooling means rated at about ½ horsepower (6000 B.T.U.) to about one (1) horsepower for each 200 gallons of tank 3 capacity are used to serve beverages. Increasing the cooling capacity to more than one (1) horsepower (e.g. 2, 3 or more horsepower) for each 100 gallons of bulk tank capacity will allow for more rapid cooling and may therefore be adapted to the invention. The higher capacity cooling units are generally not needed since once the coolant 5A is cooled and the initial beverage B stocks are cooled, the restocked baskets will generally constitute a small percentage of the over-all amount of cooled beverages B within the tank. Thus, less total cooling capacity will be required to cool the restocked beverages B after the bulk of the beverages B and coolant 5A are initially cooled.

Although a bulk milk tank filled with water (depicted as 5A) or other coolant may serve to cool bottled or canned beverages herein, substantial benefits may be accomplished by modifying the tank so that the bottled or canned beverages B may be retained within the tank 3 in a methodical arrangement such as cans or bottles B which are aligningly stacked in an organized manner within the baskets 7 and cooler 1 as may be observed from FIGS. 3–7. The use of the baskets 7 allows for orderly separation of beverage brands and a means for more accurately monitoring the brand inventory of cooled beverages at any particular time. The baskets 7 provide an efficient means for selectively partitioning the various name brands within the cooler. The baskets 7 also afford an effective vehicle for advancing the coldest stock to a serving positioning while also allowing for restocking of the cooler with fresh uncooled beverage stock and means for identifying the freshest uncooled beverage stock.

Aluminum beverage cans and other metal cans are of standardized size so as to slide or roll upon standardized trackways of conventional vending machines. The most common beverage can size (in an aluminum can) provides a 12 fluid ounce (355 ml) serving. The standardized beverage can size measures approximately four and seven-eighths (4⅞) inches in length and about two and one quarter (2174 ) inches in diameter. By referring to the preferred embodiments of the invention as especially depicted in FIGS. 4 and 7, each basket 7 is compartmentalized either by a single compartment or passageway or trackway defined as 7A for retaining the beverage cans B within the basket 7 in a horizontally aligned position. The passageway 7A feature is preferably of a sufficient size so as to receive and load the beverage cans B without jamming or a need to force the cans B into passageway 7A. Preferably passageway 7A will measure from about five inches to less than about 6 inches in size.

Figure 3:
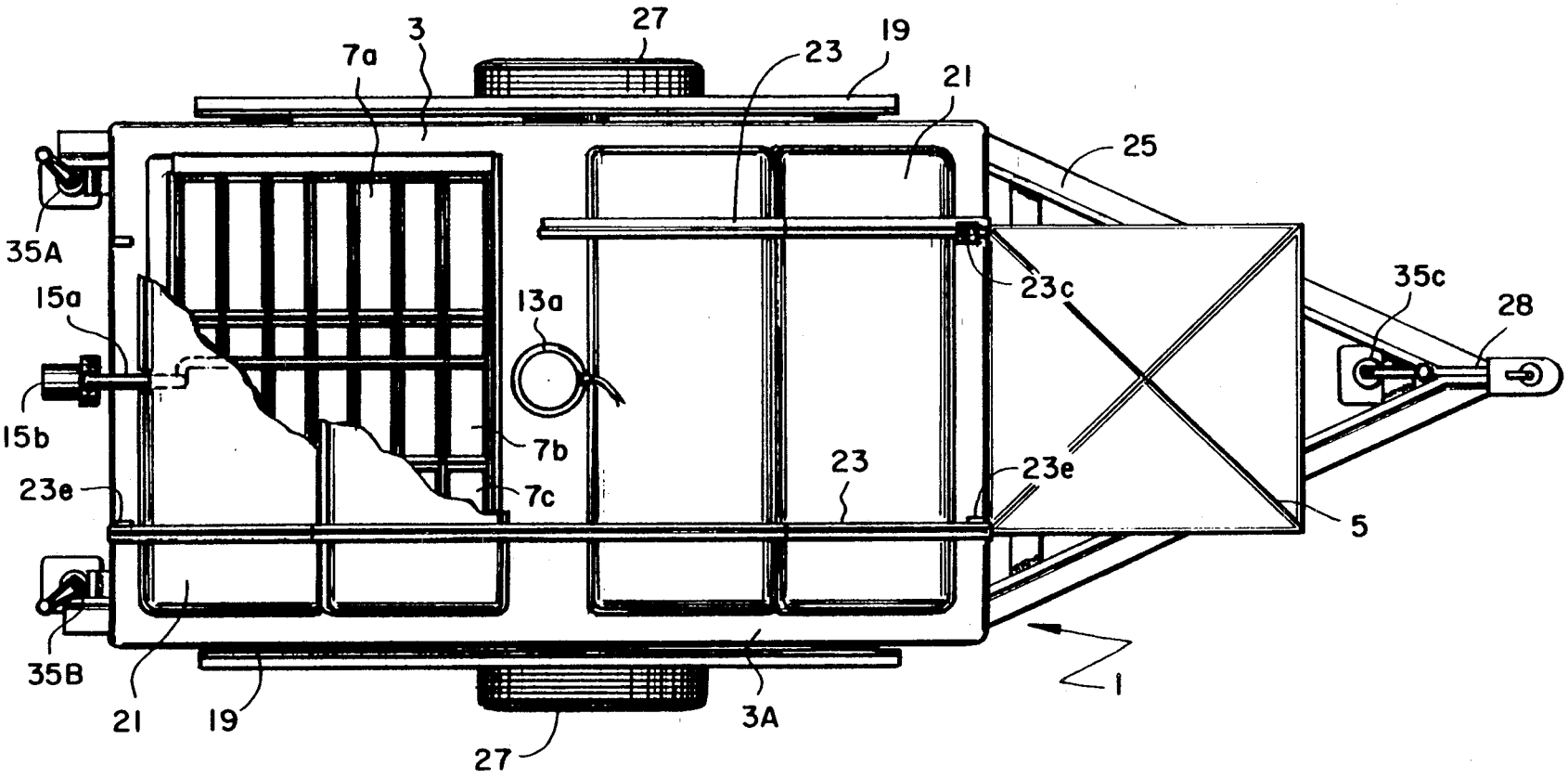
FIG. 3 is a top break-away view of the cooling device shown in FIG. 1.
Figure 5:
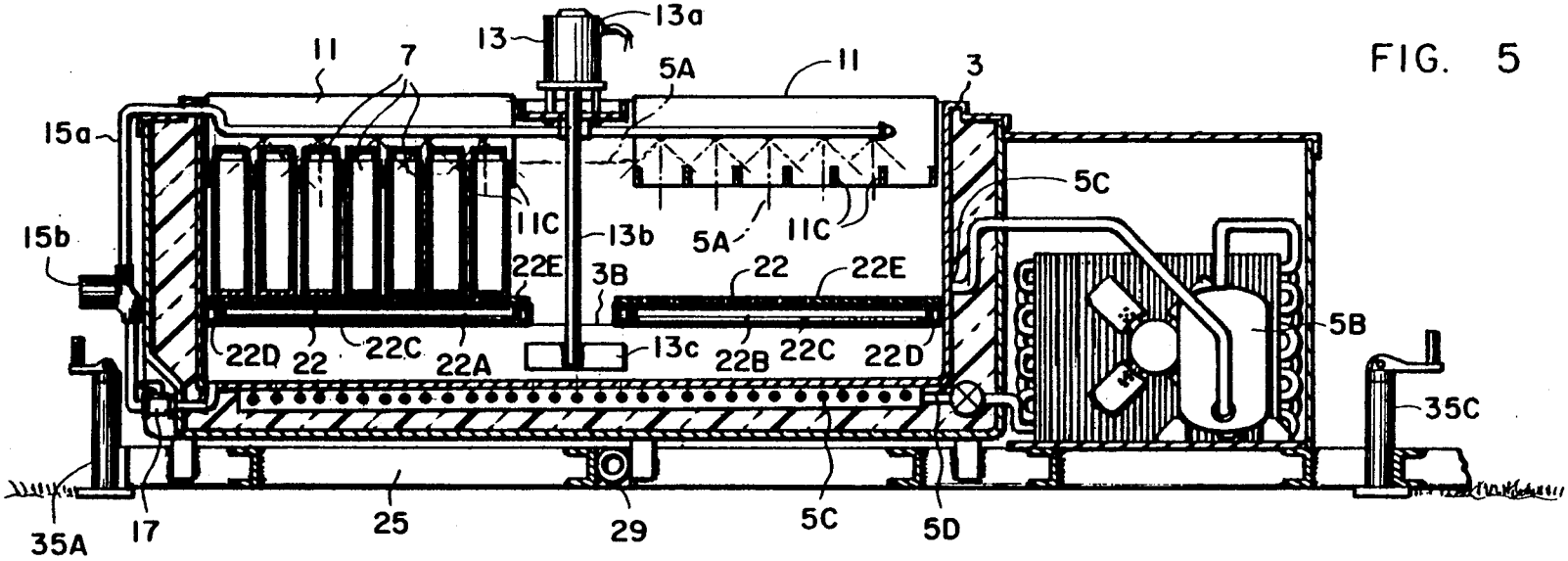
FIG. 5 is a modified cross sectional side view taken along 5—5 of FIG. 2 showing the cooling device in a beverage serving position.
Figure 7:
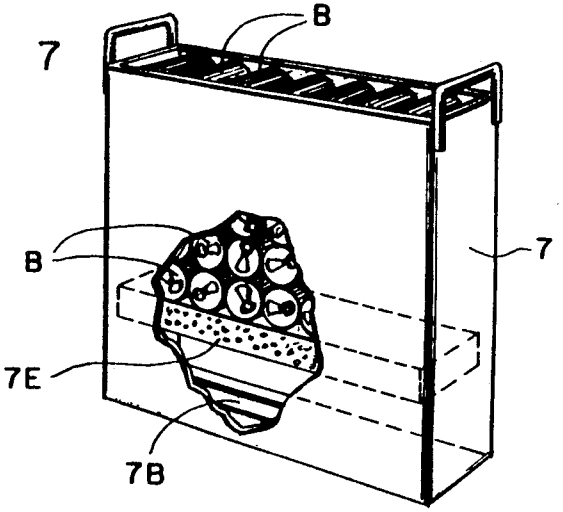
FIG. 7 shows the dispensing basket of FIG. 4 fully stocked with beverage cans and a break-away view portion depicting a flotation insert for floating heavier than water capped beverages.
Figure 6:
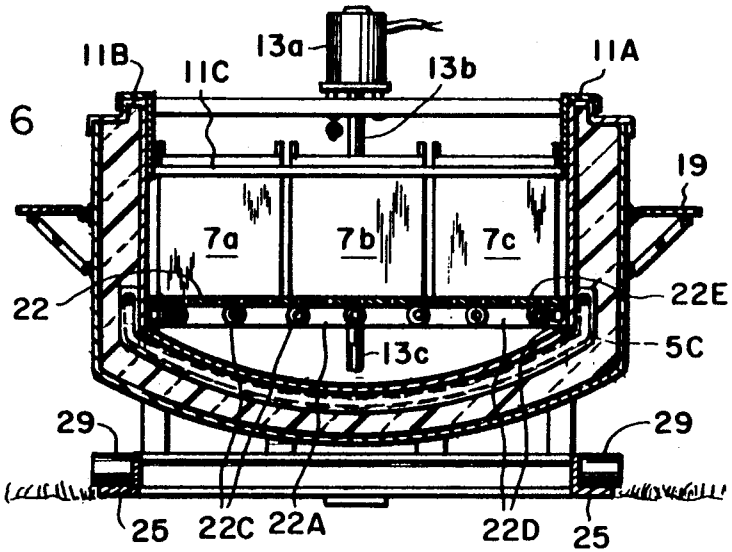
FIG. 6 is a cross sectional view taken along line 6—6 of FIG. 1.

In the depicted preferred embodiments of the invention, the retaining baskets 7 include a guided passageway (7A) of a size and configuration sufficient to retain the capped beverage (e.g. can or bottle) in a prearranged fashion such as illustrated in FIGS. 3, 5 and 6. Passageways 7A, as defined by the bottom retainer 7B and sidewalls 7C, retains the bottles or canned beverages B in horizontal alignment along the major cylindrical axis of the bottles or cans as depicted in FIG. 7. The basket bottom 7B is preferably of an open structure so as to permit water 5A to freely flow about the beverages B when basket 7 is placed or removed from tank 3. As illustrated, bottom 7B may simply comprise a pair of rails positioned at the bottom of sidewalls 7C and extending inwardly therefrom. If desired, screened or other apertured bottom retainers 7B may serve the same purpose.

It is also advantageous to size and arrange the baskets 7 in a systematic manner so that those beverage cans or bottles B having the longest residence time within tank 3 may be readily identified for serving. This may be accomplished by providing a plurality of baskets 7 sequentially arranged such as in tiers or rows (depicted as *7a, 7b, 7c,* for illustrative purposes in FIG. 3) so as to indicate or provide for a methodical placement of those capped beverages B having the longest cooling period or residence time within the cooler 1.

A basket 7 measuring about 5 inches in passageway 7A width, 22 inches in depth and 18½ inches in cross width will hold 60 12-ounce beverage cans B. A larger basket 7 size will proportionately increase the holding capacity of the basket 7. The basket 7, if desired, may include fixed or removable dividers for further subdividing the basket into smaller compartments which may be used in case of less popular beverage brands or large basket sizes. For larger basket sizes, it is desirable to include accessing or loading means such as open-ended basket for loading the baskets 7 with beverage cans B as separately depicted in FIGS. 4 and 7.

In the preferred embodiments of the invention, the baskets 7 are removable from the cooler and adapted to hold a single can row. The removable basket 7 embodiments of this invention are particularly well suited for serving large crowds with adequate volunteer help. This permits the servers to remain at their stations while allowing other site workers to load empty or reserve baskets 7 with capped beverages B and place the restocked baskets 7 in cooler 1.

Figure 4:
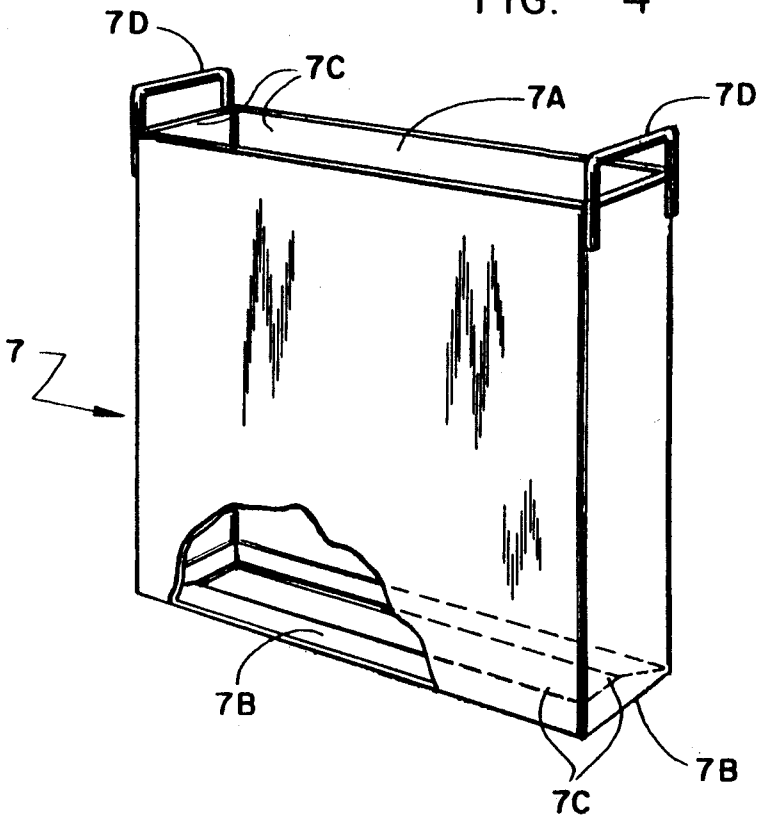
FIG. 4 shows an external view of a dispensing basket for retaining capped beverages within the cooling device of FIG. 1.

The baskets 7 as shown in FIGS. 4 and 7 are accordingly equipped with handles 7D so as to facilitate their placement and removable from the cooler. The serving baskets 7 are also preferably of a size so as to permit the baskets to be manually removed from the cooler by grasping handles 7D and removing the basket 7 from the cooler 1. Serving baskets 7 having a capacity of about one case (24 12-ounce servings per case) to about 5 cases of beverage cans advantageously from about 1½ cases about to about 4 cases and preferably about 2 to about 3 cases may be effectively used for this purpose.

The bulk cooling device 1 includes a false bottom (generally prefixed by 22) which rests upon the curved banks 3B of tank 3 near the bottom of tank 3. Typically bulk milk coolers include a curved or valleyed tank bottom longitudinally sloped towards the outlet side of tank 3 as illustrated in FIGS. 5 and 6. The false bottom 22 is utilized for purposes of standardizing the depth at which baskets 7 are immersed in water coolant 5A.

The false bottom 22 may be conveniently constructed as two separate sections 22A and 22B comprised of stainless circular tubing 22C of sufficient strength (e.g. such as 1 inch I.D. stock) spaced at a sufficient parallel distance apart (e.g. six inches apart) and welded onto a stainless steel square stock 22D (e.g. 1¼ inch square) to form two rectangular false bottom sections 22A and 22B. The false bottoms 22A and 22B are adapted to snuggly fit against the vertical longitudinal sidewalls of tank 3 and rest upon the curved banks 3B of tank. The butt ends of circular tubing 22C are welded onto the two square stock sections 22D which bridge across the valleyed portion of tank 3. Two other sections of square stock 22D are separately welded along the longitudinal axis of the two outer circular stock 22C and also butt end welded onto the two square stock sections 22D which bridge across tank 3. A stainless steel screen 22E to prevent stray cans from falling below the false bottom and fouling the stirrer 13 overlays both false bottoms 22A and 22B.

The baskets 7 are designed to rest upon the false bottom 22. The three row system (7*a*, 7*b* and 7*c*) as depicted in FIGS. 3 and 6, allows a server to serve from one side of the cooler 1 while at the other cooler 1 side may be freshly restocked beverage with a basket 7 of fresh stocked cans B to replace the empty baskets 7 removed therefrom. The baskets 7 having the longest cooling time in a three tier or row arrangement designated as row 7*a*, 7*b* and 7*c* as shown allows for those baskets having the longest residence time to be progressively moved or advanced towards the server. When a serving basket 7 in row 7*a* becomes empty, the emptied basket 7 (e.g. of row 7*a*) may be removed from tank 3 and handed to the restocking crew and the other two baskets (e.g. 7*c* and 7*d*) may each progressively advance within divider 11 towards the server. The restocked basket 7 taken from row 7*a* may then be inserted at the empty position in the cooler rear row 7*c* and later advanced towards the server when additional restocked baskets are placed in the cooler 1.

The cooler 1 under this systematic arrangement can maintain steady flow of appropriately cooled beverages B toward the server from a single serving tank 3. The more popular beverage brands may be allotted more tiers or baskets within the cooler 1 than the slower brands and therefore the embodiments of this invention assure adequate inventory control and cooling rate within a single serving tank 3. The depicted cooler 1 will normally have sufficient cooling capacity to adequately cool beverages at a heavy consumption rate.

Figure 8:
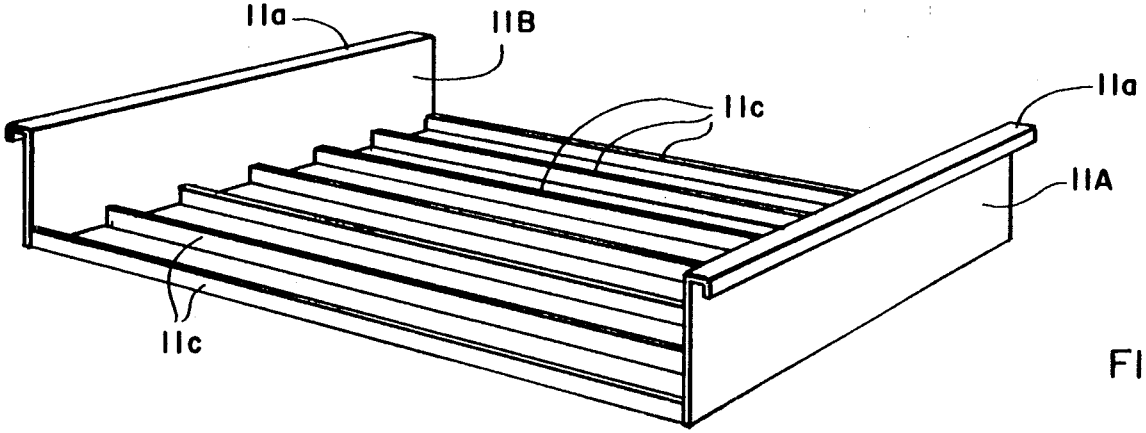
FIG. 8 depicts in greater detail a divider shown in part in FIG. 3.

A row retaining assembly 11 in the form of a grid extending crosswise across the bulk tank as shown in more detail in FIGS. 3 and 8 is used to retain or divide the baskets 7 in a three tiered (7*a*, 7*b*, 7*c*) arrangement. The depicted assembly 11 includes a front 11A and rear 11B panel respectively fitted with a channeled support bracket 11*a* for supportively interfacing onto the front top rails 3A of tank 3. The cross bars or dividers 11C are secured at opposite ends onto front panel 11A and rear panel 11B and run crosswise in a parallel relationship to one another at a spacing so as to permit the baskets 7 to be inserted and retained therebetween. The particular assembly 11 as shown in FIG. 9 allows for its removal to facilitate the cleaning and sanitizing of the tank 3 and the cooler 1 device. The cross bars 11*c* stabilize the rowed baskets 7 against upending or tipping within the cooler 1.

The cooling device 1 is equipped with a stirrer 13 powered by an electrical motor 13*a* which serves to prevent localized freezing by maintaining uniform cooling throughout the cooling tank 3. The depicted cooler 1 also includes a pipe sprinkling system 15 fitted with sprinkling nozzles 15*a* or heads which spray cold water onto the beverage cans B and pump 15*b* for circulating cold water taken at an intake position at the bottom of the tank by pump 15 and shut off valve 17 for valving the recirculating water and draining water from the tank.

Hinged, collapsible serving tables 19 are fitted on each side of bulk tank 3. The serving tables 19 allow the server to conveniently place beverage cans upon tables 19 while completing the customer orders.

The cooling device 1 includes bulk means for securing beverages B contained within tank 3 against theft which means are generally prefixed by numerals 21 and 23 inclusive.

Figure 2:
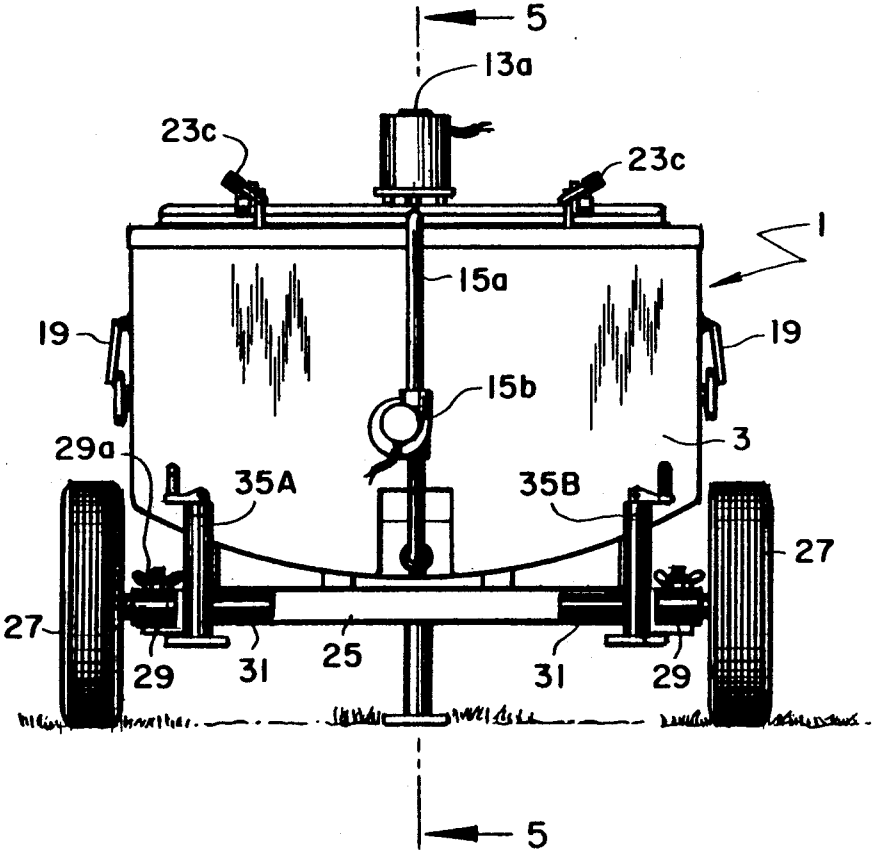
FIG. 2 is a rear view of the cooling device shown in FIG. 1.

As may be observed in FIGS. 1–3, tank 3 is typically equipped with a pair of top covering panels 21 securely locked onto the top rails 3A by a pair of security bars 23 apertured for receiving padlock links such as of an angle iron construction running lengthwise across the top cover panels 21. In the depicted embodiments, the apertured security bars 23 mate at each bar end to eye bolts 23*e* fitted onto the side top rails 3A of the bulk tank 3 which collectively serve to receive padlocks 23*c*. The locking means (21–23) of this invention may accordingly afford means for securely locking the bulk tank 3 and protecting its contents against theft at the serving site.

The cooling device 1 shown in the figures includes a carrying frame 25 for supporting the cooling device 1 and removable axled wheels 27 which may be removably latched onto the frame 25 via shaft receiving journals 29. The frame 25 as shown also includes a tongue and ball hitch assembly 28 for hitching the cooling device 1 onto a towing vehicle.

The cooling device 1 is also fitted with leveling jacks 35A, 35B and 35C so that the device 1 may be elevated to permit the wheels 27 to be removed for leveling and positioning the cooler top rail 3A to a waist high level for more convenient serving of the beverages from the tank. Leveling jacks 35A, 35B and 35C thus serve the purpose of facilitating wheel 27 removal and allow for leveling of cooler 1 at the site.

Certain beverages such as canned beer are slightly lighter than water and therefore will float within the basket 7, while other canned beverages are more dense than water. The floating attributes of certain capped beverages B may be used to advantage in this invention. For capped beverages of the floating type, the water level within the cooler 1 may be appropriately adjusted so that the upper rim of the retaining basket extends sufficiently above the water line to prevent the capped beverages B from floating out of the basket 7. For those capped beverages heavier than water (e.g. uncarbonated beverages and carbonated soft drinks formulated with heavy syrups), the basket 7 arrangement of this invention may be modified so as to include flotation means for placing the beverages B near or above the water line for convenience of serving. Such flotation means may be accomplished by inserting a flotation insert 7E of a buoyant material (e.g. foamed plastic or rubbers, wood, etc.) at the basket bottom and placing the cans thereupon as shown in FIG. 7. The buoyant material will most appropriately have sufficient buoyancy (e.g. specific gravity) so as to render the heavier than water beverages B to possess a comparable degree of flotation as the lighter than water beverages B.

The cooling device 1 as depicted in the Figures, may be unhitched from the towing vehicle at the serving site, positioned at an appropriate level positioning by elevating leveling jacks 35A, 35B and 35C so as to permit the removable axled wheels 27 to be removed from the axle shaft receiving journals 29 leveling the tank 1 to a waist-high position as illustrated in FIG. 8. The level cooling tank may then be partially filled with water 5A to an appropriate level such as enough water to provide a water line slightly below (1 or 2 inches below) the uppermost edges of the serving baskets 7. The cooling compressor assembly (generally designated as 5B), stirring system 13 and sprinkler system 15 may then be appropriately engaged by connecting the system to a suitable electrical power outlet. The cooled refrigerant is pumped through cooling coils 5C within the walls of tank 3 so as to cause the water 5A within tank 3 to rapidly cool. In the meantime, the beverage retaining baskets 7 may be stocked individually with a specific beverage brand with the more popular brands being placed in two or more baskets, preferably in the depicted three tier relationship so that a particular brand may be systematically advanced within the cooler. The water 5A and any beverage contained within tank 3 will thereby readily achieve the desired beverage serving temperature.

For illustrative purposes, an 800 gallon bulk milk tank equipped with a 4 horsepower (48,000 B.T.U.) compressor 5B will have the capacity to cool 350 gallons of water coolant at about 50 degrees F. to a temperature of about 35 degrees F. within about one hour. The 800 gallon tank 3 had a capacity to hold 42 baskets measuring 5" by 18½" by 22", each holding 60 12-ounce beverage B cans for a total of 1800 pounds of beverages (2520 beverage cans) and the cooling unit 1 cooled 60 degrees F. beverage cans to a 35 degrees F. temperature within about a one hour period.

The temperature of the coolant 5A within tank 3 is thermostatically regulated via thermostat 5D so that the cooling device will automatically maintain the water coolant 5A at the appropriate regulated cooling temperature. The need to periodically add ice and drain excess water from the cooling tank is thereby avoided by the cooling device 1 of this invention. Thus, during serving and non-serving hours the cooling device does not require manual attention. During the non-serving hours, the top covers 21 may also be secured with the padlocked security bars 23 which allow for the cooling device to be locked and left, if desired, in which unattended until serving is to commence the next day at the event.

It is also advantageous to place the baskets which are withdrawn from the cooler upon a clear pallet or rack. This will keep the baskets in a more clean and sanitary condition which in turn is more healthful to the beverage consumer and helps protect pump 15*b* against mechanical break-down. Also a screen may be placed in line in pipe 15 to remove debris which if not removed from tank 3 could cause failing of pump 15*b*.

What is claimed is:

1. A method for serving large quantities of capped beverages to patrons from a portable cooling device having a capacity to rapidly cool bulk liquids contained within an insulated holding tank, said device including compartmentalized regions within the tank for retaining buoyant capped beverages therewithin, said cooling device including vehicular means for towing the device to a serving site, circulatory means to prevent localized freezing throughout the holding tank and mechanical cooling means amounting to at least 2,000 B.T.U. for each 100 gallon capacity of said tank, said method comprising towing said portable cooling device to the serving site, adding to the insulated holding tank a liquid coolant and buoyant capped beverages within the compartmentalized regions to the tank, cooling the liquid coolant and the capped beverages to a cooled serving temperature with said mechanical cooling means while preventing localized freezing with said circulatory means and serving the cooled beverages to the patrons of said beverages.

2. The method according to claim 1 wherein the compartmentalized regions within the cooler comprises a plurality of serving baskets for retaining the capped beverages therewithin and the serving baskets are sized so as to individually retain the capped beverages in a single rowed relationship therewithin.

3. The method according to claim 2 wherein the means for towing the device to the towing site include a hitch assembly for hitching the device to a towing vehicle and vehicular wheels for transporting the device upon roadways.

4. The method according to claim 2 wherein the serving baskets comprise movable baskets equipped with handles so as to facilitate movement of the baskets within the tank and removal of said baskets from the tank for restocking with capped beverages.

5. The method according to claim 3 wherein the vehicular wheels comprise removable axled wheels and the method includes removing the removable axled wheels from the device prior to adding the liquid coolant and the capped beverages to the tank.

6. The method according to claim 4 wherein the baskets are removed from the tank for restocking with uncooled capped beverages and the restocked baskets are reinserted into the tank for cooling to the serving temperature.

7. The method according to claim 4 wherein baskets depleted of the cooled beverages are removed from the cooler and the baskets containing the cooled capped beverages are systematically identified by identifying means within the tank so as to permit a serve to identify the cooled capped beverages for serving to patrons.

8. The method according to claim 7 wherein the baskets are arranged in a tiered relationship with the baskets within a given tier being moved towards the server and baskets containing uncooled beverages being inserted in positions within the tank more further removed from the server than those baskets containing cooled beverages.

9. The method according to claim 1 wherein the cooling device has a cooling capacity ranging from about 4,000 B.T.U. to about 12,000 B.T.U. for each one hundred gallon capacity of the tank.

10. A portable cooling device for serving large quantities of capped buoyant beverages to patrons and equipped with an insulated bulk liquid holding tank and a high mechanical capacity to rapidly cool a bulk coolant confined within said holding tank, said cooling device comprising a carrying frame for supporting the holding tank, a hitch assembly for hitching the device to a towing vehicle, wheels for transporting the device with the towing vehicle, means for partitive retainment of capped buoyant beverages within said tank in a systematic relationship, cooling means rated at a cooling capacity of at least 1,000 B.T.U. for each 100 gallon holding capacity of said tank for rapidly cooling the liquid coolant and said capped buoyant beverages within said holding tank, and accessing means for emplacing and removing capped beverages from said means for partitive retainment.

11. The cooling device according to claim 10 wherein the means for partitive retainment of capped beverages comprises a plurality of movable serving baskets and the holding tank includes circulatory means for preventing localized freezing of the liquid coolant within said holding tank.

12. The cooling device according to claim 10 wherein the device includes vehicular wheels for transporting the device upon roadways.

13. The cooling device according to claim 10 wherein the cooling device includes leveling jacks for leveling the device to an appropriate serving height.

14. The cooling device according to claim 11 wherein the serving baskets are individually sized to retain a single row of capped beverages within said baskets.

15. The cooling device according to claim 11 wherein the cooling device includes a divider for dividing the baskets in a rowed relationship within said holding tank.

16. The device according to claim 13 wherein device includes removable axled wheels which may be removed from said device when the leveling jacks are elevated to a sufficient height so as to permit the removable axled wheels to be removed therefrom.

17. The device according to claim 15 wherein the divider of parallel dividing bars with the dividing bars and said baskets being sized for a placement so as to permit for a placement of at least three baskets in a rowed relationship therewithin.

18. A cooling device equipped with an insulated bulk liquid holding tank and a high mechanical capacity to rapidly cool bulk liquids confined within said holding tank, said cooling device comprising a plurality of mobile serving baskets for partitive retainment of capped beverages within said tank in a systematic relationship, means for rapidly cooling a liquid coolant and capped beverages within said holding tank, accessing means for emplacing and removing capped beverages from said serving baskets and a flotation insert for increasing the buoyancy of capped beverages placed thereupon with said flotation insert being adapted for insertion within baskets containing beverages of a density greater than that of the liquid coolant.

* * * * *